United States Patent [19]

Swinbanks

[11] Patent Number: 4,596,033

[45] Date of Patent: Jun. 17, 1986

[54] ATTENUATION OF SOUND WAVES

[75] Inventor: Malcolm A. Swinbanks, Pentlands Close, England

[73] Assignee: National Research Development Corp., London, England

[21] Appl. No.: 704,028

[22] Filed: Feb. 21, 1985

[30] Foreign Application Priority Data

Feb. 21, 1984 [GB] United Kingdom ..... 8404494

[51] Int. Cl.[4] ..... G10K 11/16; H04R 1/28

[52] U.S. Cl. ..... 381/71

[58] Field of Search ..... 381/71, 94, 73

[56] References Cited

U.S. PATENT DOCUMENTS

| | | | |
|---|---|---|---|
| 4,109,108 | 8/1978 | Coxon | 381/71 |
| 4,122,303 | 10/1978 | Chaplin | 381/71 |
| 4,153,815 | 5/1979 | Chaplin | 381/71 |
| 4,171,465 | 10/1979 | Swinbanks | 381/71 |
| 4,417,098 | 11/1983 | Chaplin | 381/71 |
| 4,473,906 | 9/1984 | Warnaka | 381/71 |
| 4,480,333 | 10/1984 | Ross | 381/71 |
| 4,489,441 | 12/1984 | Chaplin | 381/71 |

FOREIGN PATENT DOCUMENTS

| | | | |
|---|---|---|---|
| 1555760 | 11/1979 | United Kingdom | 381/71 |
| 1577322 | 10/1980 | United Kingdom | 381/71 |
| 2069280 | 8/1981 | United Kingdom | 381/71 |
| 2088951 | 6/1982 | United Kingdom | 381/71 |
| 2097629 | 11/1982 | United Kingdom | 381/71 |
| 2107960 | 5/1983 | United Kingdom | 381/71 |
| 2130651 | 6/1984 | United Kingdom | 381/71 |
| 2142091 | 1/1985 | United Kingdom | 381/71 |

*Primary Examiner*—Gene Z. Rubinson
*Assistant Examiner*—L. C. Schroeder
*Attorney, Agent, or Firm*—Cushman, Darby & Cushman

[57] ABSTRACT

When sound waves are intentionally attenuated by systems using destructive interference temporal changes sometimes cause less than optimum performance. In the present invention the transfer function of a signal processing system connected between a sound detector and a sound generator destructively interfering with an unwanted sound is modified at intervals as a result of sequential measurements of the transfer function between the sound detector and a further sound detector downstream from the generator. For this purpose a data processor calculates the required transfer function and causes a data processor to vary the coefficients of a digital filter comprising the signal processing system.

7 Claims, 2 Drawing Figures

ATTENUATION OF SOUND WAVES

Figure 1:
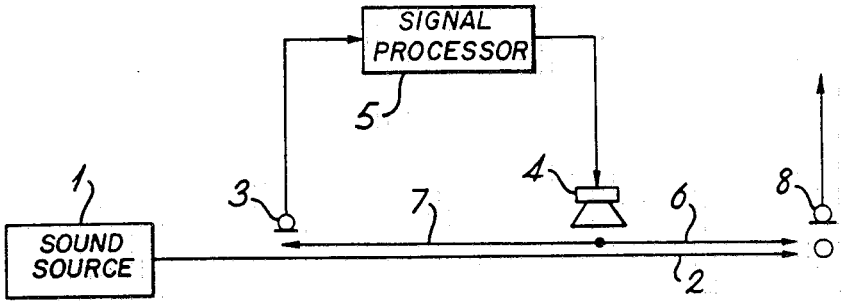

This invention relates to the attenuation of sound waves by means of active sound control techniques and, more generally, to cancellation of unwanted signals in a signal processing system.

In this specification and claims the term sound refers not only to waves propagated by compression and rarefaction in air but also to any form of waves propagated by vibration in a linear medium.

The invention is concerned in particular with active sound control systems of the kind comprising a sound detection system arranged to be responsive to an unwanted sound wave which it is desired to attenuate, a sound generating system, and a signal processing system via which a signal derived from the detection system is arranged to be fed to the generating system so as to generate a cancelling sound wave which interferes destructively with the unwanted wave in a selected spatial region. It is normally required to design such a control system so that substantial attenuation will be achieved over a range of frequencies, and it is then of course necessary for the generation of the cancelling sound wave to be controlled in respect of both amplitude and phase at any particular frequency within that range; it is also usually desirable to reduce to a minimum the possibility of excitation of the generating system at frequencies outside the relevant range. Thus to achieve optimum performance for a given installation the signal processing system is required to have a complex transfer function whose precise form will depend on factors such as the nature of the source of the unwanted wave, the constitution of the sound generating system, the form of the acoustic paths involved, and the characteristics of the transducers (e.g. microphones and loudspeakers) respectively used in the sound detection and generating systems. At least some of these factors may well be subject to significant variation with time, and it may therefore be desirable to make provision for the automatic adjustment of the signal processing system, at least on an intermittent basis, so as to maintain the performance of the control system close to the optimum.

It is an object of the present invention to provide an arrangement which meets this objective without requiring the adoption of any measures that would interfere with the normal operation of the control system.

According to a first aspect of the invention, there is provided an active sound control system, comprising a first sound detection system arranged to be responsive to an unwanted sound wave which it is desired to attenuate, a sound generating system, a signal processing system via which a signal derived from the detection system is arranged to be fed to the generating system so as to generate a cancelling sound wave which interferes destructively with the unwanted wave in a selected spatial region, a second sound detection system located at an observation point suitable for monitoring the performance of the control system, means for effecting a sequence of measurement operations each of which defines over a given frequency range the transfer function between the respective outputs of the first and second detection systems, and means for making a sequence of adjustments of the signal processing system such that the Rth adjustment is made between the (R+1)th and (R+2)th measurement operations and causes the transfer function of the signal processing system to have at any frequency in said range a value substantially equal $T_R P_{R+1} - T_{R+1} P_R)/(P_{R+1} - P_R)$, where $T_R$ and $T_{R+1}$ represent the values at said frequency which the transfer function of the signal processing system had respectively on the occasions of the Rth and (R+1)th measurement operations, and $P_R$ and $P_{R+1}$ respectively represent the corresponding values in respect of said transfer function between the outputs of the two detection systems.

According to a second aspect of the invention there is provided a method of active sound control comprising generating at a first point a first signal representative of an unwanted sound wave which it is desired to attenuate, processing the first signal to provide a drive signal for generating a cancelling sound wave which destructively interferes with the unwanted wave in a selected spatial region, generating at a second point a second signal representative of any sound wave resulting from the destructive interference, making a sequence of measurement operations each of which defines over a given frequency of range the transfer functions between the first and second points, and making a sequence of adjustments to the processing of the first signal such that the Rth adjustment is made between the (R+1)th and (R+2)th measurement operations and causes the transfer function of the first signal processing to have at any frequency in the said range a value substantially equal to $(T_R P_{R+1} - T_{R+1} P_R)/P_{R+1} - P_R$, where $R_R$ and $T_{R+1}$ represent the values at said frequency which the transfer function of the first signal processing had respectively on the occasions of the Rth and (R+1)th measurement operations, and $P_R$ and $P_{R+1}$ respectively represent the corresponding values in respect of the transfer function between the first and second points.

More generally, the invention may be applied to other signal processing systems than those concerned with the attenuation of sound waves where unwanted signals are to be cancelled.

Figure 2:
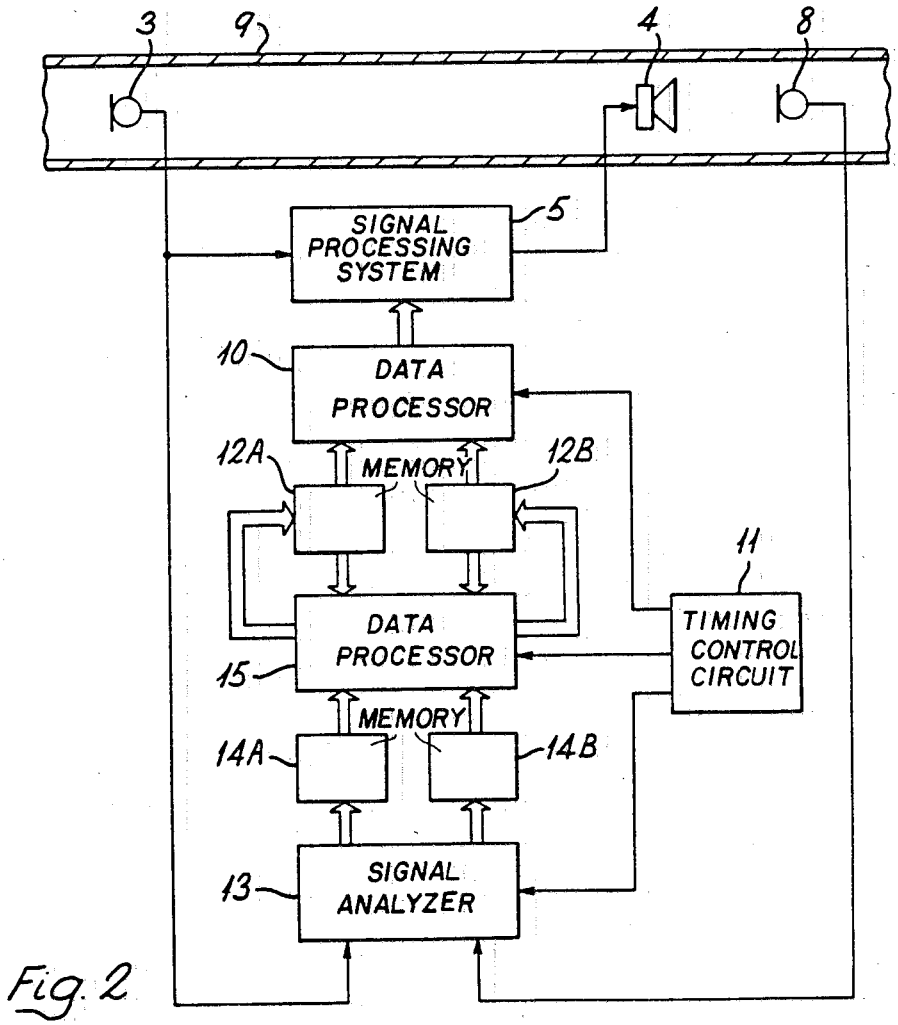

The invention will be further described and explained with reference to the accompanying drawings, in which:

FIG. 1 is a diagram illustrating certain principles of active sound control systems ot the kind specified; and FIG. 2 is a diagrammatic illustration of one active sound control system according to the invention.

FIG. 1 iliustrates a situation (treated for simplicity on a one-dimensional basis) in which it is desired to attenuate a sound wave emanating from a source 1 and indicated by the arrow 2. For this purpose there is provided an active sound control system including a sound detection system indicated by the microphone 3 and a sound generating system indicated by the loudspeaker 4. The detection system 3 is arranged to be responsive to the wave 2 and its output is fed via a signal processing system 5 to the generating system 4 so as to generate a cancelling sound wave indicated by the arrow 6. It is assumed that the system 3 is also responsive to sound generated by the system 4, the acoustic coupling between these systems being represented by the arrow 7. It is further assumed that the control system is required to operate so as to achieve in a region to the right of the diagram effective cancellation of those components of the wave 2 having frequencies within a given range; the performance of the system in this respect can be monitored by observation of the output of a further sound detection system indicated by the microphone 8 and located at an observation point 0 within the relevant region. In order to ensure that the operation of the control system does not give rise to a significant risk of enhancement of the sound level in this region in respect of components having frequencies outside the given range, it is appropriate to arrange for the system 5 to exhibit the characteristics of a band-pass filter having a pass band corresponding to that frequency range.

Complete cancellation at the point 0 of a component of given frequency in the wave 2 of course requires that the wave 6 should have a component of the same frequency such that at 0 the two components will have the same amplitude but be of opposite phases, and corresponds to a zero value of the output of the detection system 8 at the relevant frequency. This output (P) is given by the equation $$P=NP_N+SP_S \tag{1}$$

where N, S, $P_N$, and $P_S$ respectively represent the values at the relevant frequency of the output of the source 1, the output of the system 5, the transfer function from the source 1 to the output of the system 8, and the transfer function from the output of the system 5 to the output of the system 8. Since both the amplitude and phase characteristics are relevant these value will in general be complex numbers (which are of course liable to vary with frequency). The corresponding output (D) of the detection system 3 is given by the equation $$D=ND_N+SD_S \tag{2}$$

where $D_N$ and $D_s$ respectively represent the values at the relevant frequency of the transfer function from the source 1 to the output of the system 3 and the transfer function from the output of the system 5 to the output of the system 3 via the acoustic coupling between the systems 4 and 3; the relationship between S and D is given by the equation $$S=TD \tag{3}$$

where T represents the value at the relevant frequency of the transfer function of the system 5.

From the foregoing equations it can readily be deduced that P will be zero if, and only if, T has the value $(D_S-P_SD_N/P_N)^{-1}$; this ideal value is subsequently denoted by $T_o$. Optimum performances of the control system requires that T should be equal to $T_o$ over the whole of the given frequency range; in practice it is of course only possible to achieve an approximation to this. Where the design of the control system can be treated on a permanent basis, so that the setting up of the system 5 to achieve the desired transfer function is a once for all operation, it will commonly be appropriate in meeting that objective to proceed on the basis of knowledge, derived from preliminary experiments, of the forms of the four transfer functions whose values appear in the expression for $T_o$ given above. Such an approach is not, however, practicable where the control system is to be of the adaptive type, in which provision is made for adjusting the system 5 automatically to take account of temporal changes in the factors which determine the desired form of its transfer function.

The present invention is based on an alternative approach involving consideration of the transfer function between the respective outputs of the systems 3 and 8, the value of which at a given frequency is equal to the ratio P/D. Denoting this by $P_D$, it can be deduced from the equations quoted above that $$P_D=(1-T/T_o)P_N/D_N \tag{4}$$

The transfer function between the respective outputs of the systems 3 and 8 is thus linearly related to the transfer function of the system 5; in optimising the latter by making T equal to $T_o$ one is of course causing $P_D$ to have the value zero. Equation (4) can be utilised to establish the value of $T_o$ for a given frequency by making measurements of $P_D$ at that frequency with T having two different known values. Denoting these values by $T_A$ and $T_B$ and the corresponding values of $P_D$ by $P_A$ and $P_B$, using equation (4) it can be deduced that $$T_o=(T_AP_B-T_BP_A)/(P_B-P_A) \tag{5}$$

This result is strictly valid only if there has been no change between the two measurements in the factors on which $T_o$ depends; in practice, however, equation (5) affords a sufficiently good approximation for use as the basis of adjustment of the system 5 in a control system of the adaptive type, so long as the interval between the measurements is sufficiently short to ensure that any change in the factors on which $T_o$ depends is relatively small.

With an adaptive system it is of course required to make a sequence of adjustments of the system 5, each adjustment being such as to make T approximate to the current best estimate of $T_o$ over the relevant frequency range. In following the approach based on equation (5) it is appropriate to make this sequence of adjustments in response to a sequence of measurement operations in each of which $P_D$ is evaluated for an appropriate series of frequencies. Because the first adjustment cannot be made until after two measurement operations have been completed, the two sequences are staggered so that the Rth adjustment is made between the (R+1)th and (R+2)th measurement operations. For each adjustment one of course utilises the most recent data available from the measurement operations, so that the value of $T_o$ used for the Rth adjustment—subsequently denoted by $(T_o)_R$—is calculated from equation (5) using the values of T and $P_D$ relevant to the Rth and (R+1)th measurement operations; thus denoting these values of T by $T_R$ and $T_{R+1}$ and the corresponding values of $P_D$ by $P_R$ and $P_{R-1}$, we have $$(T_o)_R=(T_RP_{R+1}-T_{R+1}P_R)/(P_{R+1}-P_R) \tag{6}$$

as the general equation defining the basis for adjustment of the system 5. It will be appreciated that, since the Rth adjustment is followed by the (R+2)th measurement operation $T_{R+2}$ will be substantially equal to $(T_o)_R$; the value of $T_{R+2}$ is of course required in calculating $(T_o)_{R+1}$ and $(T_o)_{R+2}$, and for this purpose can be taken as exactly equal to $(T_o)_R$. It remains to consider the beginning of the procedure, since the choice of $T_1$ and $T_2$ is clearly arbitrary. Conveniently $T_1$ may be chosen as zero (corresponding to an open circuit condition of the system 5) and $T_2$ as a number K (invariant with frequency) such that the control system operates stably (but preferably not far from instability); equation (6) then of course gives the value $KP_1/(P_1-P_2)$ for $(T_o)_1$ and hence $T_3$.

With the procedure just discussed, it will be seen that once the first adjustment has been made the control system will at all times operate in accordance with the current best estimate of $T_o$, and that no requirement arises for the injection of extraneous tests signals or the introduction of large test perturbations in the transfer function of the system 5.

Referring now to FIG. 2, the sound control system illustrated therein as designed to attenuate a sound wave travelling along a duct 9 (from left to right as seen in the drawing), the attenuation being effective in respect of components of the sound having frequencies within a wide range which might typically be 30–250 Hz. The system includes sound detection systems 3 and 8 a generating system 4, which are disposed in the duct 9 at longitudinally separated locations such that the system 3 is nearest to and the system 8 furthest from the source of the wave to be attenuated. A signal derived from the detection system 3 is fed via a signal processing system 5 to the generating system 4 so as to generate a cancelling sound wave which travels along the duct 9 in the same direction as the wave to be attenuated, the system 5 being arranged to exhibit the characteristics of a bandpass filter having a pass band corresponding to the frequency range over which attenuation is required.

The system 5 incorporates a programmable digital filter, which may suitably operate with a sampling frequency of 800 Hz when the frequency range over which attenuation is required is as quoted above. The coefficients of the digital filter are periodically set, as a result of a sequence of individual operations of a data processor 10, so that over an appropriate frequency range the transfer function of the system 5 approximates as closely as possible to a form defined by data representing desired values of the transfer function at a set of discrete frequencies spanning said range. The timing of the operations of the processor 10 is controlled by signals generated by a timing control circuit 11, and might typically be arranged so that the operations occur once or twice a minute. The data for each operation of the processor 10 are derived from one or other of a pair of memories 12A and 12B, which are used alternately for successive operations; for the sake of definiteness it will be taken that the memory 12A is used for the odd-numbered operations of the sequence. In the starting condition of the control system, data are stored in the memory 12A representing zero value for the transfer function of the system 5 at all said discrete frequencies, while data are stored in the memory 12B representing a constant value K for the transfer function of the system 5 at all said discrete frequencies, K being chosen so that the control system will operate stably (but preferably not far from instability). These data initially stored in the memories 12A and 12B of course control the first and second settings of the coefficients of the digital filter; for the control of subsequent settings the contents of the memories 12A and 12B are periodically updated in a manner to be described below.

The computational procedure involved in the operations of the data processor 10 is akin to the well-known technique referred to in the art as "system identification", but differs in approach because the desired transfer function is explicitly defined. In standard system identification methods, it is usual for the basic data to be constituted by an input time series and an output time series, from which autocorrelation and cross-correlation functions are determined; these are used to calculate a correlation matrix which is in turn inverted in order to derive digital filter coefficients. In the present case, however, the procedure adopted involves specifying an appropriate input signal spectrum corresponding to a random signal in the time domain, and calculating thereform the corresponding output signal spectrum and input-output cross-spectrum for a system having a transfer function of the defined form; the three spectra are then transformed to generate autocorrelation and cross-correlation data which are used in the derivation of the coefficients of the digital filter in the same way as in standard system identification.

The sound control system further includes a signal analyser 13 to which are fed signals respectively derived from the sound detection systems 3 and 8, the analyser 13 being arranged to effect a sequence of measurement operations whose timing is controlled by signals generated by the circuit 11 and is such that each measurement operation follows the correspondingly numbered setting of the coefficients of the digital filter. For each measurement operation, the analyser 13 is programmed to derive the value, at each of the discrete frequencies of the set referred to above, of the transfer function between the respective outputs of the systems 3 and 8. Data representing the results of each odd-numbered measurement operation are temporarily stored in a memory 14A, and data representing the results of each even-numbered measurement operation are temporarily stored in a memory 14B.

The updating of the contents of the memories 12A and 12B is effected by means of a sequence of individual operations of a further data processor 15; the timing of these operations is once again controlled by signals generated by the circuit 11, and is such that each measurement operation except the first is followed by an operation of the processor 15, which is in turn completed prior to the start of the next numbered operation of the processor 10. Each operation of the processor 15 involves the calculation, for each of the discrete frequencies of the set referred to above, of the value of $T_o$ given by equation (5), in this case taking $T_A$, $T_B$, $P_A$ and $P_B$ to be the values at the relevant frequency of the transfer functions represented by the data stored respectively in the memories 12A, 12B, 14A and 14B immediately prior to the start of the operation. Each operation further involves replacement of the data initially stored in one of the memories 12A and 12B by data representing the values of $T_o$ calculated in that operation, while leaving unchanged the data stored in the other of these memories; the updated memory is 12A if the last measurement operation was an even-numbered one and 12B if the last measurement operation was an odd-numbered one.

The invention may be put into practice in many other ways than those specifically described. For example although reference has been made to random noise over a broad band, the invention is equally applicable to discrete frequencies (when the frequency range mentioned becomes a single frequency or a group of discrete frequencies) and/or periodic noise. Either or both sound detection systems may, for periodic noise, comprise means for synchronising the signal generating system with the unwanted sound wave.

Systems other than for sound attenuation include electrical systems where the duct may, for example, be replaced by impedances and the sound detection systems by electrical connections. Other examples of systems to which the invention can be applied include those employing electromagnetic waves (including waveguides and (optical fibres), and digital systems.

I claim:

1. An active sound control system, comprising a first sound detection system arranged to be representative of an unwanted sound wave which it is desired to attenuate, a sound generating system, a signal processing system via which a signal derived from the detection system is arranged to be fed to the generating system so as to generate a cancelling sound wave which interferes destructively with the unwanted wave in a selected spatial region, a second sound detection system located at an observation point suitable for monitoring the performance of the control system, means for effecting a sequence of measurement operations each of which defines over a given frequency range the transfer function between the respective outputs of the first and second detection systems, and means for making a sequence of adjustments of the signal processing system such that the Rth adjustment is made between the (R+1)th and (R+2)th measurement operations and causes the transfer function of the signal processing system to have at any frequency in said range a value substantially equal to $(T_R P_{R+1} - T_{R+1} P_R)/(P_{R+1} - P_R)$, where $T_R$ and $T_{R+1}$ represent the values at said frequency which the transfer function of the signal processing system had respectively on the occasions of the Rth and (R+1)th measurement operations, and $P_R$ and $P_{R+1}$ respectively represent the corresponding values in respect of said transfer function between the outputs of the two detection systems.

2. A system according to claim 1 wherein the means for making a sequence of adjustments comprises first and second stores for storing signals representing even and odd numbered values, respectively, of the transfer functions between the said respective outputs of the two detection systems, third and fourth stores for storing signals representing even and odd numbered values, respectively, of the transfer function of the signal processing system, and a first data processor for calculating successive values of the transfer function of the signal processing system from the contents of the said stores.

3. A system according to claim 2 wherein the signal processing system comprises a programmable digital filter and the means for making a sequence of adjustments comprises a second data processor for setting the coefficients of the filter in accordance with signals from the first data processor.

4. A system according to claim 1 wherein the means for effecting a sequence of measurement operations includes a frequency analyser connected to receive signals from the first and second sound detection systems.

5. A method of active sound control comprising generating at a first point a first signal representative of an unwanted sound wave which it is desired to attenuate, processing the first signal to provide a drive signal for generating a cancelling sound wave which destructively interferes with the unwanted wave in a selected spatial region, generating at a second point a second signal representative of any sound wave resulting from the destructive interference, making a sequence of measurement operations each of which defines over a given frequency of range the transfer functions between the first and second points, and making a sequence of adjustments to the processing of the first signal such that the Rth adjustment is made between the (R+1)th and (R+2)th measurement operations and causes the transfer function of the first signal processing to have at any frequency in the said range a value substantially equal to $(T_R P_{R+1} - T_{R+1} P_R)/P_{R+1} - P_R$, where $R_R$ and $T_{R+1}$ represents the values at said frequency which the transfer function of the first signal processing had respectively on the occasions of the Rth and (R+1)th measurement operations, and $P_R$ and $P_{R+1}$ respectively represent the corresponding values in respect of the transfer function between the first and second points.

6. A method according to claim 6 wherein the first and second values of the transfer function of the first signal processing are respectively zero, and a value such that the first and second signals are near oscillation but stable.

7. A system for cancelling unwanted signals comprising a first signal detection system arranged to be representative of an unwanted signal which it is desired to attenuate, a signal generating system, a signal processing system via which a signal derived from the detection system is arranged to be fed to the generating system so as to generate a cancelling signal which interferes destructively with the unwanted signal, a second signal detection system coupled at a point suitable for monitoring the performance of the control system, means for effecting a sequence of measurement operations each of which defines over a given frequency range the transfer function between the respective outputs of the first and second detection systems, and means for making a sequence of adjustments of the signal processing system such that the Rth adjustment is made between the (R+1)th and (R+2)th measurement operations and causes the transfer function of the signal processing system to have at any frequency in said range a value substantially equal to $(T_R P_{R+1} - T_{R+1} P_R)/(P_{R+1} - P_R)$, where $T_R$ and $T_{R+1}$ represent the values at said frequency which the transfer function of the signal processing system had respectively on the occasions of the Rth and (R+1)th measurement operations, and $P_R$ and $P_{R+1}$ respectively represent the corresponding values in respect of said transfer function between the outputs of the two detection systems.

* * * * *